US008733863B2

(12) United States Patent
Kwak et al.

(10) Patent No.: US 8,733,863 B2
(45) Date of Patent: May 27, 2014

(54) WASHING MACHINE

(75) Inventors: Dae Wook Kwak, Changwon-si (KR); Jong Min Kim, Changwon-si (KR); Han Ki Cho, Changwon-si (KR); Soon Jo Lee, Changwon-si (KR); Kyu Chul Lee, Changwon-si (KR); Cheol Kang Heo, Changwon-si (KR)

(73) Assignee: LG ELectronics Inc., Seoul (KR)

( * ) Notice: Subject to any disclaimer, the term of this patent is extended or adjusted under 35 U.S.C. 154(b) by 245 days.

(21) Appl. No.: 13/320,424

(22) PCT Filed: Jul. 29, 2010

(86) PCT No.: PCT/KR2010/004981

§ 371 (c)(1),
(2), (4) Date: Nov. 14, 2011

(87) PCT Pub. No.: WO2011/014018

PCT Pub. Date: Feb. 3, 2011

(65) Prior Publication Data

US 2012/0056518 A1 Mar. 8, 2012

(30) Foreign Application Priority Data

Jul. 30, 2009 (KR) ..... 10-2009-0069979
Jul. 30, 2009 (KR) ..... 10-2009-0069983

(51) Int. Cl.
*A47B 49/00* (2006.01)

(52) U.S. Cl.
USPC ..... 312/326

(58) Field of Classification Search
CPC ..... E05C 17/50; D06F 39/14; D06F 37/28; H01H 13/06; H01H 13/183
USPC ..... 312/326–329, 228; 292/340
See application file for complete search history.

(56) References Cited

U.S. PATENT DOCUMENTS

| | | | | |
|---|---|---|---|---|
| 3,474,470 | A * | 10/1969 | Watson | 4/240 |
| 3,488,667 | A * | 1/1970 | Gutshall | 16/321 |
| 2007/0130730 | A1* | 6/2007 | Cho et al. | 16/387 |
| 2011/0062838 | A1* | 3/2011 | Kim et al. | 312/228 |
| 2011/0146159 | A1* | 6/2011 | Zhang et al. | 49/394 |
| 2012/0023704 | A1* | 2/2012 | Case | 16/321 |
| 2012/0032569 | A1* | 2/2012 | Hill et al. | 312/228 |

FOREIGN PATENT DOCUMENTS

| | | | |
|---|---|---|---|
| CN | 101187134 | A | 5/2008 |
| EP | 0443361 | A1 | 8/1991 |
| EP | 1333118 | A1 | 8/2003 |

* cited by examiner

*Primary Examiner* — Darnell Jayne
*Assistant Examiner* — Timothy M Ayres
(74) *Attorney, Agent, or Firm* — McKenna Long & Aldridge LLP

(57) ABSTRACT

A laundry machine (1) including a cabinet (10) having an opening (10*a*) for loading and/or unloading laundry, a door (300) selectively opening and/or closing the opening of the cabinet (10), and a door positioning unit (A) for positioning the door (300) away from the cabinet (10).

13 Claims, 8 Drawing Sheets

WASHING MACHINE

This application is a 35 U.S.C. §371 National Stage entry of International Application No. PCT/KR2010/004981, filed on Jul. 29, 2010, and claims the benefit of Korean Patent Application Nos. 10-2009-0069979, filed Jul. 30, 2009, and 10-2009-0069983, filed Jul. 30, 2009, each of which are hereby incorporated by reference in their entireties as if fully set forth herein.

TECHNICAL FIELD

The present invention relates to a washing machine. More particularly, the present invention relates to a washing machine enhancing the ventilation between the inside and outside of the washing machine while the washing machine is not operated.

BACKGROUND ART

Generally, a washing machine collectively refers to a washer washing laundry using washing water and a dryer drying the washed laundry with dry air. Herein, a washing machine may perform any one of the washing function and the drying function, or a washing machine may perform both washing and drying functions.

Meanwhile, depending upon the method of inserting laundry into the washing machine, the washing machine may be broadly divided into a top loading type and a front loading type.

A front loading type washing machine and a top loading type washing machine, which has a drum rotating therein, broadly consist of a cabinet forming an exterior of the washing machine, and a drum rotatably fixed therein. Herein, the drum accommodates laundry that is to be washed. In a state accommodating the laundry therein, the drum rotates on a horizontal or vertical axis so as to perform a series of processes including washing, rinsing, and spin-drying or drying.

However, after all of the washing, rinsing, and spin-drying or drying processes are completed, when a considerable amount of time passes while moisture or a small amount of water still remains inside the drum, the remaining water may cause an unpleasant odor to occur. Therefore, in order to enhance the convenience of the washing machine for the user, the remaining water and humidity should be eliminated.

Meanwhile, a latch corresponding to a locker is provided on a door of the washing machine. By fastening the latch to the cabinet, the washing machine may be sealed so as to block the outside air to be flown into the drum. In a washing machine provided with such a latch, unless the latch is fastened to the cabinet, the door fails to be completely closed. However, even in this case, since a gasket comes in contact with the door, the problem still remains in that the water remaining inside the drum of the washing machine is not completely dried and eliminated.

DISCLOSURE OF INVENTION

Technical Problem

An object of the present invention is devised to solve the problem lies on providing a washing machine which discharges remaining moisture to the outside from a drum by setting (or positioning) a door in preset positions, when the washing machine is not being used.

Solution to Problem

To achieve these objects and other advantages and in accordance with the purpose of the invention, as embodied and broadly described herein, a laundry machine includes a cabinet having an opening for loading and/or unloading laundry, a door selectively opening and/or closing the opening of the cabinet, and a door positioning unit for positioning the door away from the cabinet.

The door positioning unit may include a supporting member selectively projectable from the door or cabinet.

More specifically, the supporting member may be rotatable from the door or cabinet.

The door positioning unit may further include a magnet provided in the supporting member for keeping the door in contact with the cabinet.

Moreover, the magnet may be provided at the end of the supporting member at an opposite side of the rotating shaft.

In the meantime, the door positioning unit may further include a receiving part accommodating the supporting member.

Moreover, the door positioning unit may further include an elastic member forcing the supporting member to project and a restrictor preventing the supporting member from projecting.

More specifically, the restrictor may include a hook provided in one side of the supporting member, and a catcher provided in the receiving part and engaging the hook.

Herein, the supporting member may be selectively engaged with the catcher by applying pressure to the supporting member.

In the mean time, the door positioning unit may be configured to stepwise rotate the door so that the door can be positioned in a preset position.

More specifically, the door positioning unit may include a shaft having a non-circular cross-section for stepwise rotation and a boss engaged with the shaft.

Herein, the door positioning unit may be provided in a hinge assembly for selectively rotating the door.

Moreover, the shaft may be extended from a hinge shaft of the hinge assembly.

In the meantime, the hinge assembly may include a hinge arm, wherein a first end of the hinge arm may be hingedly connected to the cabinet, and wherein a second end of the hinge arm may be hingedly connected to the door, and a first hinge shaft and a second hinge shaft respectively provided in the first end and second end of the hinge arm, and wherein the door positioning unit may be provided in at least one of the first hinge shaft and the second hinge shaft.

The hinge assembly may further include a bracket fixed to the cabinet, and the first end of the hinge arm may be hingedly connected to the bracket.

Herein, the door positioning unit may further include a first unit being provided in the first hinge shaft, and a second unit being provided in the second hinge shaft.

In the meantime, it is preferable that a friction force of the second shaft of the second unit is greater than that of the first shaft of the first unit.

Moreover, it is preferable that the shaft of the door positioning unit has a polygonal cross-section.

The hinge assembly may further include a torsion spring restoring rotation of the first hinge shaft, and the friction force of the first shaft of the first unit is greater than a restoring force of the torsion spring.

In the meantime, the shaft may include a stepper for stepwise rotating the door.

Advantageous Effects of Invention

As described above, the washing machine according to the embodiment of the present invention has the following advantages. When the washing machine is not being used, by preventing the door from being completely closed, air permeability may be ensured, thereby preventing unpleasant odor or other problems of hygiene from occurring due to water remaining inside the washing machine.

BEST MODE FOR CARRYING OUT THE INVENTION

Hereinafter, the washing according to an embodiment of the present invention will now be described in detail with reference to the accompanying drawings.

The washing machine according to the present invention may also correspond to a dryer. However, an example of a washing machine functioning as a washer will be given in the following description of the present invention, for simplicity.

Figure 1:
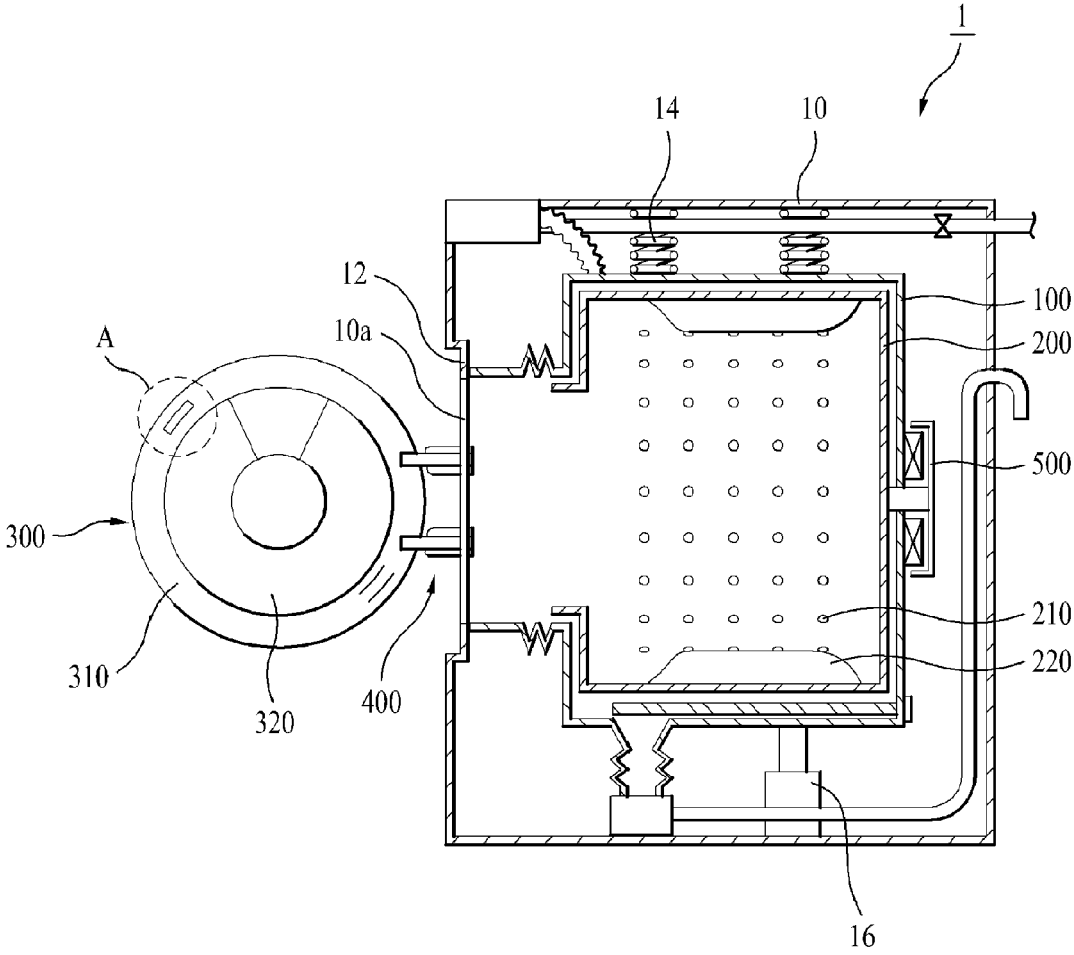
FIG. 1 illustrates a cross-sectional view of a washing machine according to the present invention.

Referring to FIG. 1, the general structure of the washing machine is as follows. More specifically, the washing machine (1) according to the present invention consists of a cabinet (10) forming an exterior of the washing machine (1) and having an opening (10*a*) formed at the front portion of the cabinet (10), a tub (100) installed inside of the cabinet (10) so as to accommodate washing water therein, and a drum (200) rotatably fixed inside the tub (100) so as to accommodate dirty laundry therein.

The tub (100) is elastically fixed to the cabinet (10) by a suspension spring (14) and a damper (16). A plurality of pass-through holes (210) is formed in the drum (200) so as to allow water to flow in. And, a plurality of lifters (220) for evenly mixing the laundry is fixed on the inner circumferential surface of the drum (200).

A driving device (500) for rotating the drum (200) is installed on a rear portion of the tub (100) so as to rotate the drum (200).

The opening (10*a*) formed on the front portion of the cabinet (10) is opened and/or closed by a door (300). And, the door (300) is rotatably supported by a hinge assembly (400).

The door (300) is configured of a door glass (320) and a door frame, which is fastened to the outer circumference of the door glass (320). Herein, the door frame is configured of an inner frame (310) and an outer frame (not shown).

After all of the washing, rinsing, and spin-drying or drying processes are completed by using the washing machine, a small amount of water may still remain inside the drum and the tub. However, such remaining water may cause the occurrence of an unpleasant odor within the washing machine. Moreover, such unpleasant odor may also occur in the washed laundry, thereby causing problems in hygiene.

In order to resolve such problems, a door positioning unit may be provided in the washing machine, so as to maintain a predetermined gap between the door and the cabinet. Therefore, by ensuring air permeability in the drum and the tub, the remaining amount of water may be easily eliminated or evaporated.

In order to resolve such problems, the washing machine according to the embodiment of the present invention is provided with a door positioning unit, which maintains a predetermined gap between the door (300) and the cabinet (10), while the washing machine is not operated. In other words, the door positioning unit keeps the door away from the cabinet while the washing machine is not operated. Therefore, by ensuring air permeability in the drum (200) and the tub (100), the water remaining in the washing machine may be easily eliminated.

Figure 2:
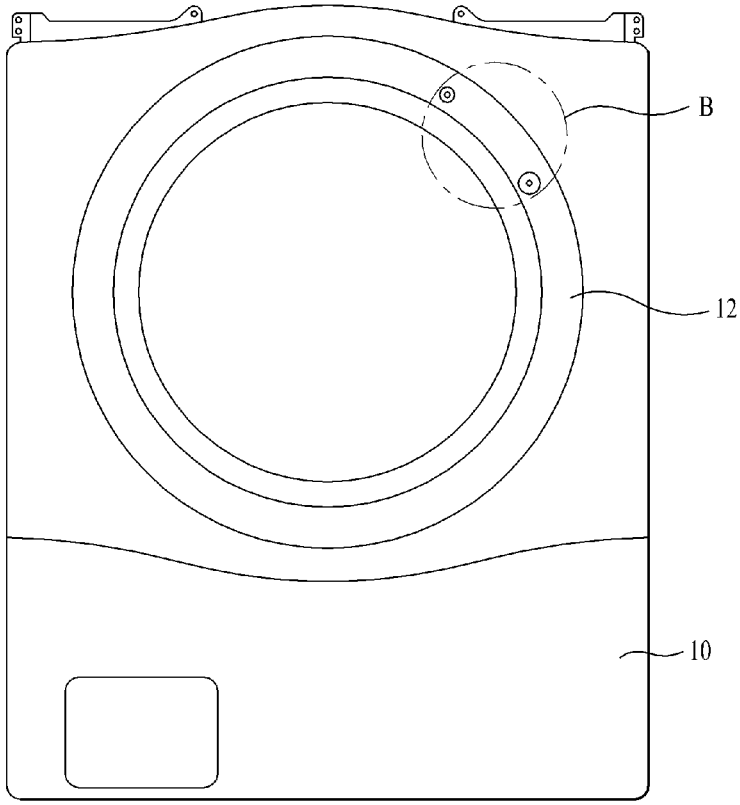
FIG. 2 illustrates a front view of a cabinet of a washing machine.
Figure 3:
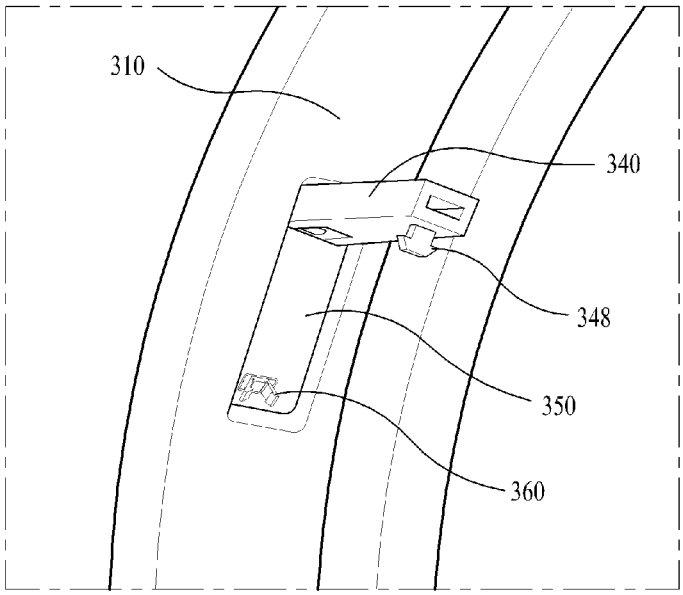
FIG. 3 and FIG. 4 illustrate perspective views showing the operation of a door positioning unit according to a first embodiment of the present invention.
Figure 4:
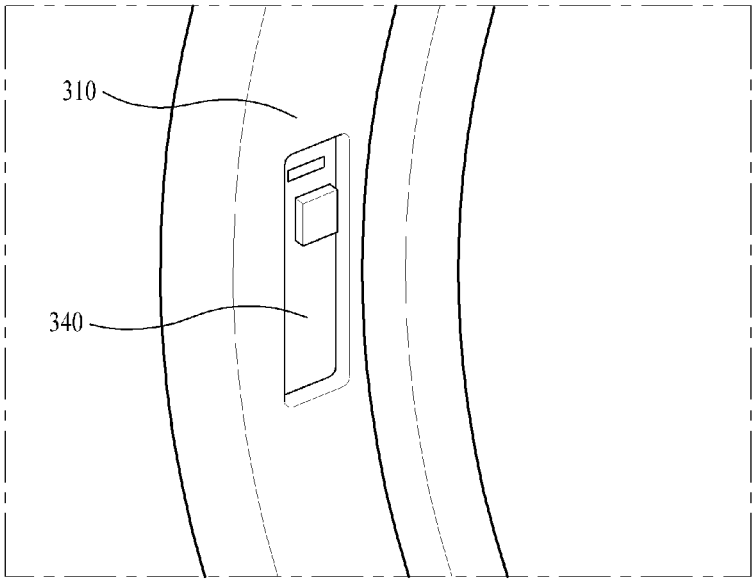

The washing machine according to the first embodiment of the present invention will be described as follows with reference to FIG. 2 to FIG. 4. Referring to FIG. 2 to FIG. 4, the door positioning unit is provided in the inside (refer to A of FIG. 1) of the door (300). Most particularly, it is preferable that the door positioning unit is provided in the inside of the inner frame (310).

The door positioning unit may selectively be in contact with the door (300) or protruded from the door (300). Accordingly, when the user attempts to close the door (300) while the door positioning unit is in a protruded state, the door positioning unit comes into contact with the B portion of the cabinet (10), thereby preventing the door (300) from being completely closed. Thus, the door (300) may be maintained in an open state.

Hereinafter, the door positioning unit according to the first embodiment of the present invention will now be described in detail with reference to FIG. 5 and FIG. 6.

The door positioning unit includes a supporting member 340, which is provided on one side of the inner frame (310). Also, it is preferable that the inner frame (310) is provided with a receiving part (350), which is formed in a dented form so as to accommodate the supporting member (340). The receiving part (350) is recessed from a surface of the inner frame (310)

Being formed in the shape of a bar, one end of the supporting member (340) is rotatably fixed to the receiving part (350) by a rotating shaft (346). Moreover, the door positioning unit may further include a restrictor that prevents the supporting member (340) from projecting. The restrictor includes a hook (348) and a catcher (360), wherein the hook (348) is provided on one side of the supporting member (340), and wherein the catcher (360) is provided on one side of the receiving part (350) and is engaged with the hook (348). Evidently, the catcher (360) is provided in a position respective to the hook (348). Also, the rotating shaft (346) may further include an elastic member that can force the supporting member (340) to project out. Herein, the elastic member allows the supporting member (340) received in the receiving part (350) to project to the outside. The elastic member may correspond to a torsion spring (344). At this point, the torsion spring (344) may be installed so as to be extended when the supporting member (340) is received in the receiving part (350), and to be restored when the supporting member (340) projects outside of the inner frame (310).

Figure 5:
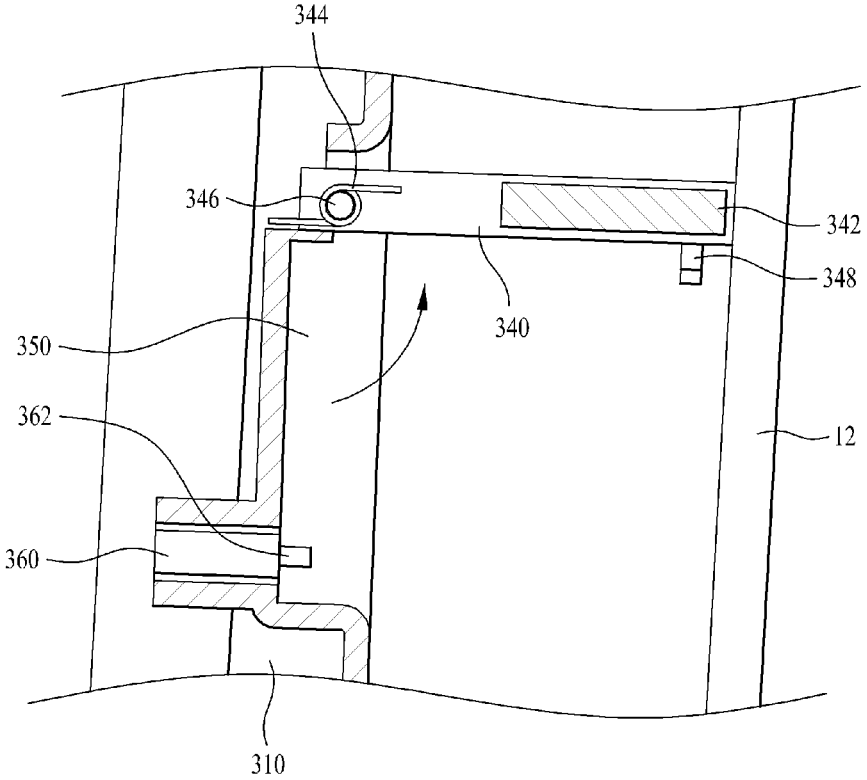
FIG. 5 and FIG. 6 respectively illustrate cross-sectional views showing a state of operation of FIG. 3 and FIG. 4.

Referring to FIG. 5, the supporting member (340) rotates so as to project to the exterior side of the inner frame (310). The supporting member (340) is projected in a direction parallel to a tangent, which is formed by a rotating-door locus of the door. More specifically, in case the supporting member (340) is in a projected state, the supporting member (340) is positioned so as to be perpendicular to the inner frame (310). Referring to FIG. 6, the supporting member (340) rotates once again so as to be received in the receiving part (350). In other words, as the hook (348) is engaged with the catcher (360), which is provided in the receiving part (350), the supporting member (340) may be prevented from being ejected from the receiving part (350).

Figure 7:
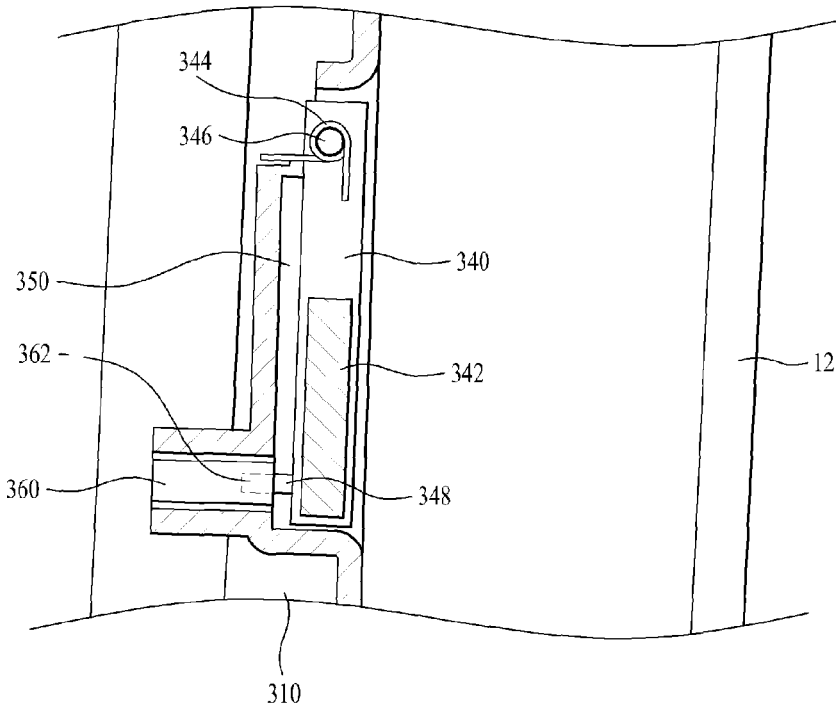
FIG. 7 and FIG. 8 illustrate perspective views of a catcher.
Figure 8:
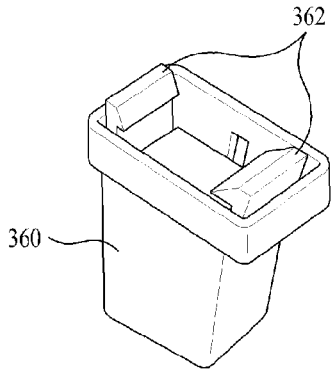

Meanwhile, the catcher will be described with reference to FIG. 7 and FIG. 8. Herein, the catcher (360) is provided with two crooks (362). The crooks (362) are engaged with the hook (348). Referring to FIG. 7, when the engagement between the hook (348) and the catcher (360) is released, the crooks (362) maintain a projected state from the catcher (360). Furthermore, referring to FIG. 8, when the hook (348) is engaged with the catcher (360), the crooks (360) are accommodated inside the catcher (360). At this point, the gap between the two crooks (362) becomes smaller, so that the hook (348) cannot be ejected from the crooks (362).

The engagement and release of the hook (348) and the catcher (360) will now be described with reference to FIG. 5 and FIG. 6. It is preferable that the engagement and release of the hook (348) and the catcher (360) is realized in a one-touch method. More specifically, when the hook (348) and the catcher (360) are engaged, and, in this case, when the user applies pressure once on the portion of the supporting member (340) being provided with the hook (348), the engagement between the hook (348) and the catcher (360) is released. Furthermore, due to a restoring force of the torsion spring (344), the supporting member (340) projects to the outside of the inner frame (310). (In order to prevent impact noise from occurring during the rotation of the supporting member (340), a cushion structure made of a shock-absorbing material may be additionally provided on one side of the supporting member (340).) Also, when the engagement between the hook (348) and the catcher (360) is released, when pressure is applied to the supporting member (340) until the crooks (362) of the catcher (360) are led into the inside of the catcher (360), the hook (348) is engaged with the crooks (362) of the catcher (360).

Meanwhile, a magnet (342) may be provided inside the supporting member (340). The magnet (342) maintains the projected state of the supporting member (340) in contact with the cabinet (10). Generally, the cabinet (10) is formed of a magnetic substance such as steel. Therefore, due to the attractive force between the magnet (342), which is provided on one end of the supporting member (340), and the cabinet (10), the supporting member (340) may be maintained in a projected state. Meanwhile, although it is shown in FIG. 5 and FIG. 6 that the magnet (342) and the torsion spring (344) are provided simultaneously, the supporting member (340) may be fixed by using only the magnet (342). At this point, it is preferable that the magnet (342) is provided at the end of the supporting member (340) in opposite side of the rotating shaft (346). In case the torsion spring (344) does not exist and the magnet (342) is provided on one end of the supporting member (340), when the door (300) is spaced further apart from the cabinet (10), i.e., when a magnetic field of the magnet (342) does not sufficiently reach the cabinet (10), due to its own weight, the supporting member (340) is received in the receiver (350). At this point, when the door (300) is rotated so as to bring the supporting member (340) closer to the cabinet (10), the supporting member (340) is automatically projected due to the attractive force between the magnet (340) and the cabinet (10). Conversely, in case the door (300) is completely sealed, and if the door (300) is opened by using the latch, the door (300) is spaced apart from the cabinet (10) at a predetermined distance. And, accordingly, the supporting member (340) is automatically projected due to the attractive force between the magnet (340) and the cabinet (10).

Figure 6:
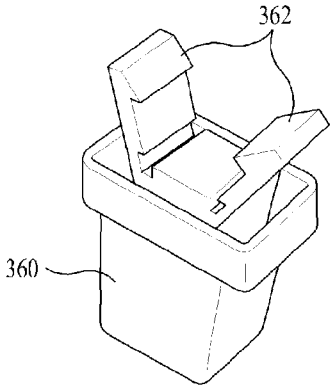

Although it is described in the above description that the magnet (342) provided in the supporting member (340) and the torsion spring (344) provided on the rotating shaft (346) are selectively disclosed, it is apparent that the two structures may be simultaneously provided, as shown in FIG. 5 and FIG. 6.

As described above, by using the door positioning unit according to the first embodiment of the present invention, the door (300) may be prevented from being completely closed. Thus, the door positioning unit according to the first embodiment of the present invention is advantageous in that air permeability may be ensured even while the washing machine is not being operated.

Meanwhile, the door positioning unit may be provided on the cabinet (10) (portion B) and not on a side of the door (300). Although the position of the door positioning unit is not limited to above-mentioned position, it is preferable that the door positioning unit fixed to a position opposite to the hinge assembly, which rotatably supports the door (300), in order to avoid interference with other surrounding elements and also for the simplicity of fabrication.

Furthermore, although it is described in the first embodiment of the present invention that the supporting member (340) is configured to have a structure that is projected by being rotated, the supporting member (340) may also be led into the door (300) by using a slide.

Hereinafter, the door positioning unit according to a second embodiment of the present invention will now be described in detail with reference to the accompanying drawings.

As described in the first embodiment of the present invention, the second embodiment of the present invention is also devised to prevent the door from being completely closed. However, in the second embodiment of the present invention, the rotation of the door may be stepwise performed. Accordingly, the door may be positioned in a desired position.

Figure 9:
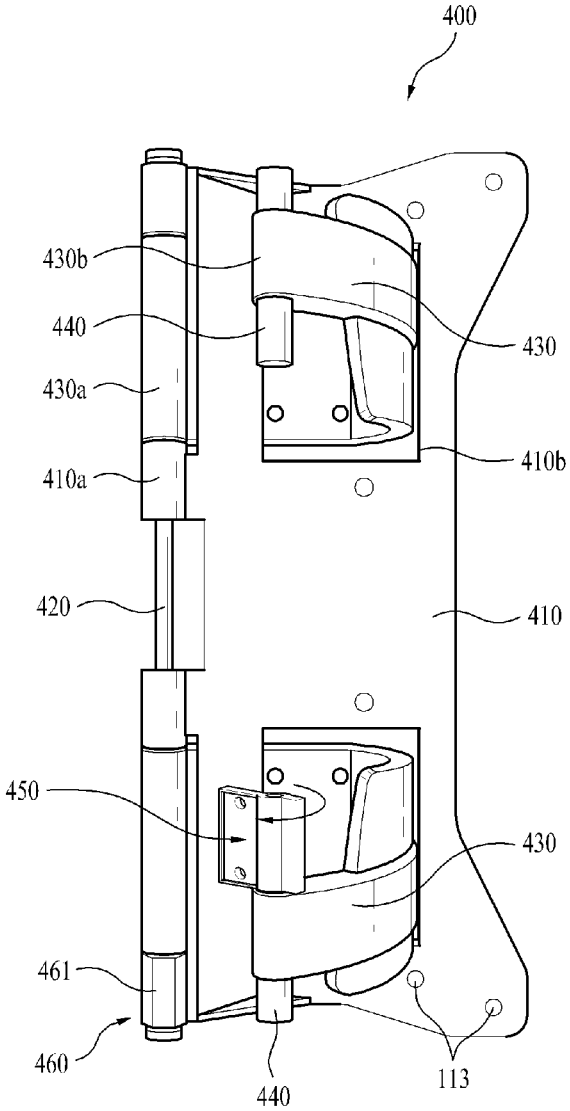
FIG. 9 and FIG. 10 illustrate perspective views showing the operation of a door positioning unit according to a second embodiment of the present invention.
Figure 10:
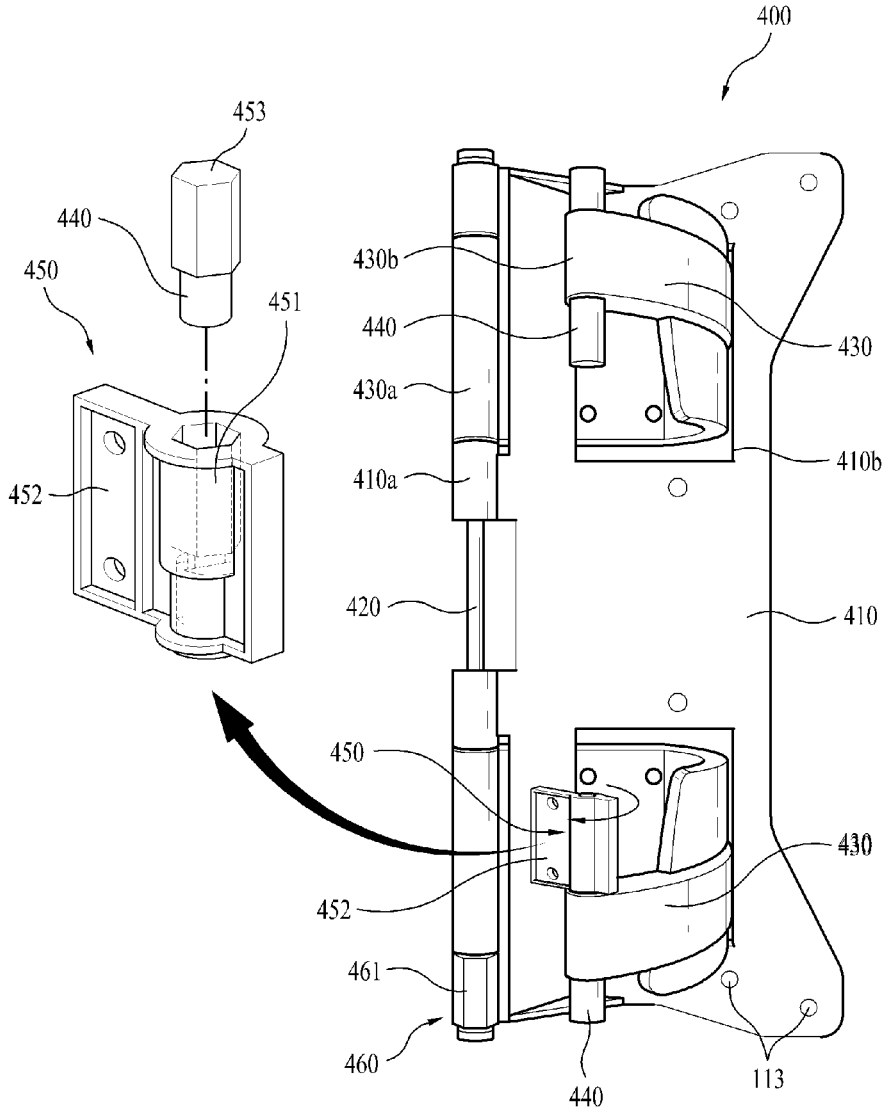

First of all, the hinge assembly (400) will be described in detail with reference to FIG. 9 and FIG. 10.

Although it will be described in the second embodiment of the present invention that two hinge shafts are provided herein, an example of using only one hinge shaft may also be applied in the present invention.

The hinge assembly (400) includes a bracket (410), which fixed to the cabinet (10). Also, the hinge assembly (400) includes a first end (430*a*) being hingedly connected to the bracket (410) and a second end (430*b*) being hingedly connected to a hinge arm (430). Furthermore, the hinge assembly (400) also includes a first hinge shaft (420) and a second hinge shaft (440) respectively provided in the first end (430*a*) and the second end (430*b*) of the hinge arm (430).

The bracket (410) is fixed to an inner front surface of the cabinet (10). A fastening hole (113) is formed on one side of the bracket (410), so as to fix the bracket (410) to the cabinet (10) by using a fastening member. Furthermore, a first shaft engager (410*a*) engaging with the first hinge shaft (420) is provided on another side of the bracket (410). Also, an opening (410*b*) is provided on a center of the bracket (410) so as to allow the hinge arm (430) to rotate therethrough.

The hinge arm (430) is formed in a streamlined shape, wherein the first end (430*a*) is hingedly connected to the bracket (410). Additionally, the second end (430*b*) of the hinge arm (430) passes through the opening (410*b*) so as to be protruded to the front portion of the bracket (410). Also, two hinge shafts (420 and 440) are provided on the hinge arm (430). The first hinge shaft (420) is provided at a position where the bracket (410) is engaged with the hinge arm (430), and the second hinge shaft (440) is provided at a position where the hinge arm (430) is engaged with the door (300). Accordingly, the hinge arm (430) rotates on the first hinge shaft (420), and the door (300) rotates on the second hinge shaft (440). More specifically, when the user pulls the door (300), the hinge arm (430) primarily rotates on the first hinge shaft (420), and the door secondarily rotates on the second hinge shaft (440). In order to prevent interference between the door (300) and the cabinet (10) from occurring, the door (300) may be rotatably supported by a hinge assembly (400) having the above-described double-hinge structure. The second hinge shaft (440) may be formed as a single body with hinge arm (430).

Meanwhile, although it is not shown in the drawing, a torsion spring that restores the rotation of the first hinge shaft (420) may be provided on the first hinge shaft (420).

The door positioning unit is configured by including a shaft having a non-circular cross-section and a boss being engaged with the shaft. Since the shaft has a non-circular cross-section, the door (300) may be stepwise opened and/or closed due to a friction force between the shaft and the boss. The door positioning unit may be provided on the hinge assembly (400). The cross-section of the shaft corresponds to a non-circular cross-section including a structure having protrusions formed on a circular cross-section. Meanwhile, although it may sufficient to have the cross-section of the shaft configured in a non-circular shape, it is preferable that the cross-section of the shaft is formed to have a polygonal shape. Furthermore, although the shaft of the door positioning unit may be separately provided in addition to the hinge shaft of the hinge assembly, it is preferable that the shaft of the door positioning unit is formed as a single body. Herein, the door positioning unit may be provided in at least one of the first hinge shaft (420) and the second hinge shaft (440). Hereinafter, an example of the door positioning unit according to the second embodiment of the present invention being provided in the first hinge shaft (420) and the second hinge shaft (440) will now be described in detail.

The door positioning unit includes a first unit (460) being provided on the first hinge shaft (420) and a second unit (450) being provided on the second hinge shaft (440). Herein, the first unit (460) is configured of a first shaft having a polygonal shape and a first boss (461) being engaged with the first shaft. Also, the second unit (450) is configured of a second shaft having a polygonal shape and a second boss (451) being engaged with the second shaft.

The second shaft (453) having a polygonal cross-section is provided on the second hinge shaft (440). Additionally, the second boss (451), which is engaged with the second shaft (453), has a center hole having a polygonal shape formed therein so as to allow the second shaft (453) to be engaged. Furthermore, the second shaft (453) may extend to the second hinge shaft (440) so as to form a single body with the second hinge shaft (440). Meanwhile, a door connector (452) may be provided on one side of the second boss (451).

Moreover, the first unit (460) is provided on the first hinge shaft (420), and, preferably, the first unit (460) is provided on an edge of the first hinge shaft (420). As described in the description of the second unit (450), the first shaft of the first unit (460) has a polygonal cross-section, and the first shaft may be extended to the first hinge shaft (420) so as to form a single body.

Hereinafter, the operation of the door positioning unit according to the second embodiment of the present invention will now be described in detail with reference to FIG. 11 to FIG. 13.

Figure 11:
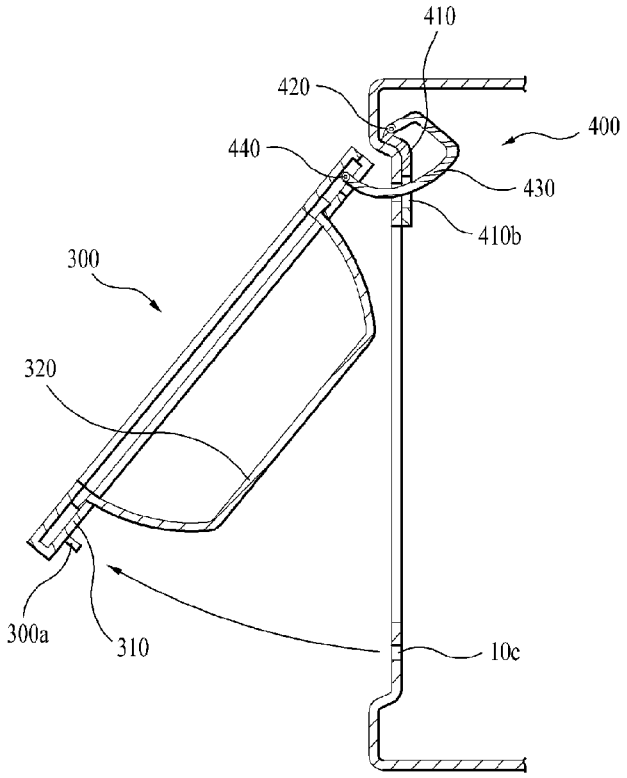
FIG. 11 to FIG. 13 illustrate plane views showing an opening order of a door.

Referring to FIG. 11, in case the door (300) is in a sealed state, i.e., in case the latch (300*a*) of the door (300) is engaged with a latch connector (10*c*), when the door (300) is opened for the first time, the hinge arm (430) rotates on the first hinge shaft (420). At this point, due to the first unit (460) provided on the first hinge shaft (420), the hinge arm (430) is not continuously rotated but stepwise rotated. More specifically, when the outer surfaces of the first shaft match with and fit into the section of the center hole of the first boss (461), the hinge arm (430) stepwise rotates with intermittently stopping at positions corresponding to the angles of the polygonal shape of the first shaft.

Figure 12:
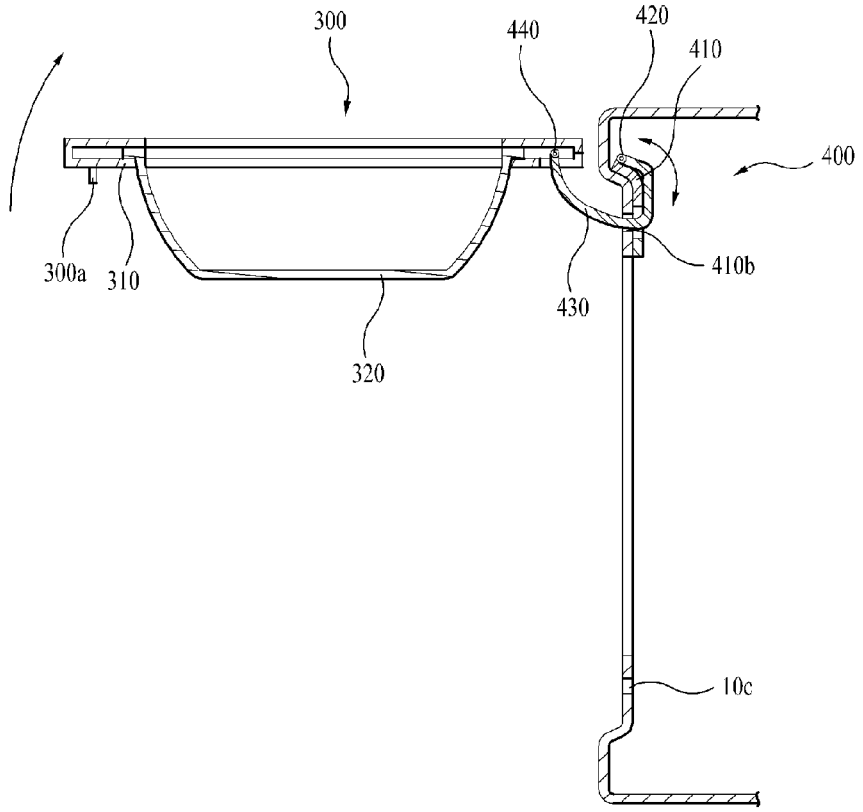
Figure 13:
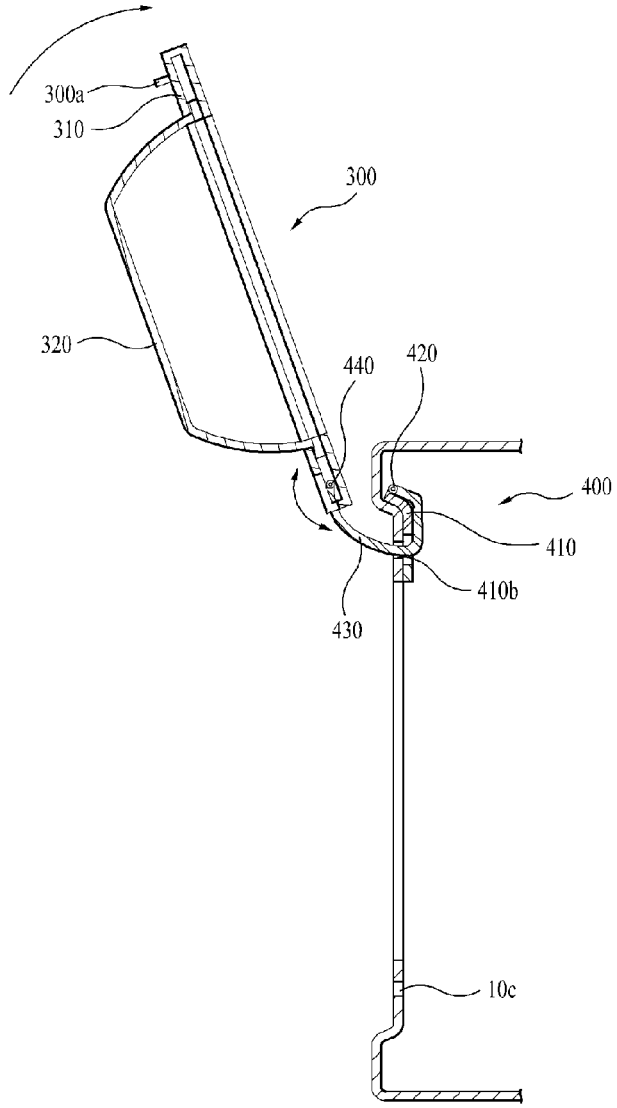

FIG. 12 illustrates a state of the hinge arm (430) being rotated to a maximum extent so as to come into contact with the inner side of the cabinet (10). At this point, if the door (300) is further rotated, the door (300) rotates on the second hinge shaft (440) (refer to FIG. 13). Similarly, in this case, due to the second unit (450) provided on the second hinge shaft (440), the door (300) is stepwise rotated. More specifically, when the outer surfaces of the second shaft (453) match with and fit into the section of the center hole of the second boss (451), the door (300) stepwise rotates with intermittently stopping at positions corresponding to the angles of the polygonal shape of the second shaft.

If the cross-section of the second hinge shaft (440) corresponds to a hexagon, the door (300) may be a free stop in 6 stages. Accordingly, the opening angle may also be adjusted in 6 stages.

Meanwhile, as described above in the description of the door positioning unit, in order to allow the hinge arm (430) to rotate first and to allow the door to rotate afterwards, it is preferable that the friction force between the second shaft (453) and the second boss (451) is greater than the friction force between the first shaft and the first boss (461). Furthermore, it is also preferable that the friction force between the first shaft and the first boss (461) is greater than the restoring force of the torsion spring restoring the rotation of the first hinge shaft (420). Accordingly, due to the weight of the door and the restoring force of the torsion spring, the door (300) may be maintained at an angle opened by the user, without having to move to a closing position.

Since the door (300) may perform free-stop due to the first unit (460) and the second unit (450), the user may leave and maintain the door (300) at a desired opened state. Accordingly, after using the washing machine, the door (300) may maintain its open state until the water remaining in the drum (200) and the tub (100) is completely eliminated. Thereafter, when the water remaining in the washing machine is completely dried and eliminated, the user may close the door (300) so as to preserve the washing machine.

Figure 14:
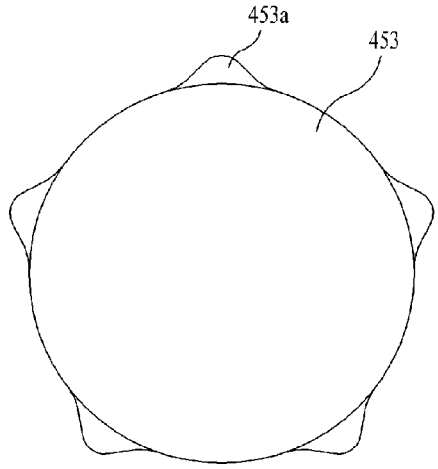
FIG. 14 illustrates a cross-sectional view of a shaft included in the door positioning unit.

Meanwhile, the shaft (453) of the door positioning unit may have a cross-section as shown in FIG. 14. More specifically, the shaft (453) of the door positioning unit may be formed to have a structure provided with a stepper (453*a*) on the outer circumferential surface of the shaft (453). The stepper (453*a*) may be formed on the outer circumferential surface of the shaft (453) so as to be protruded, and the stepper (453*a*) may be formed as a single body with the shaft (453).

Meanwhile, the present invention will not be limited only to the exemplary embodiments described herein. Therefore, it will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

The invention claimed is:

1. A laundry machine, comprising:

a cabinet having an opening for loading and/or unloading laundry;

a door selectively opening and/or closing the opening of the cabinet; and a door positioning unit for positioning the door away from the cabinet, wherein the door positioning unit comprises a supporting member selectively projectable from the door or cabinet, an elastic member forcing the supporting member to project and a restrictor preventing the supporting member from projecting, wherein the supporting member is configured to be rotatable from the door or cabinet and in case the supporting member is in a projected state, the supporting member is positioned so as to be perpendicular to an inner frame of the door, and wherein the door positioning unit comprises a magnet provided in the supporting member for keeping the door in contact with the cabinet.

2. The laundry machine as claimed in claim 1, wherein the magnet is provided at the end of the supporting member at an opposite side of the rotating shaft.

3. The laundry machine as claimed in claim 1, wherein the door positioning unit further comprises a receiving part accommodating the supporting member.

4. The laundry machine as claimed in claim 1, wherein the restrictor comprises:

a hook provided in one side of the supporting member; and a catcher provided in the receiving part and engaging the hook.

5. The laundry machine as claimed in claim 4, wherein the supporting member is selectively engaged with the catcher by applying pressure to the supporting member.

6. A laundry machine, comprising:

a cabinet having an opening for loading and/or unloading laundry;

a door selectively opening and/or closing the opening of the cabinet; and a door positioning unit for positioning the door away from the cabinet comprises: a shaft having a non-circular cross-section for stepwise rotation; and a boss engaged with the shaft, wherein the door positioning unit is provided in a hinge assembly for selectively rotating the door, wherein the hinge assembly comprises: a hinge arm, wherein a first end of the hinge arm is hingedly connected to the cabinet, and wherein a second end of the hinge arm is hingedly connected to the door;

a first hinge shaft and a second hinge shaft respectively provided in the first end and second end of the hinge arm, wherein the door positioning unit is provided in at least one of the first hinge shaft and the second hinge shaft, wherein the shaft is formed as a single body with the first hinge shaft or the second hinge shaft, and wherein the door positioning unit is configured to stepwise rotate the door so that the door can be positioned in a preset position.

7. The laundry machine as claimed in claim 6, wherein the shaft is extended from a hinge shaft of the hinge assembly.

8. The laundry machine as claimed in claim 6, wherein the door positioning unit further comprises:

a first unit being provided in the first hinge shaft, and a second unit being provided in the second hinge shaft.

9. The laundry machine as claimed in claim 8, wherein a friction force of the second shaft of the second unit is greater than that of the first shaft of the first unit.

10. The laundry machine as claimed in claim 9, wherein the hinge assembly further comprises a bracket fixed to the cabinet, and wherein the first end of the hinge arm is hingedly connected to the bracket.

11. The laundry machine as claimed in claim 6, wherein the shaft of the door positioning unit has a polygonal cross-section.

12. The laundry machine as claimed in claim 10, wherein the hinge assembly further comprises a torsion spring restoring rotation of the first hinge shaft, and wherein the friction force of the first shaft of the first unit is greater than a restoring force of the torsion spring.

13. The laundry machine as claimed in claim 6, wherein the shaft includes a stepper for stepwise rotating the door.

* * * * *